United States Patent [19]

Hartmannsgruber

[11] 4,348,860

[45] Sep. 14, 1982

[54] SPINNING OR TWISTING MACHINE

[75] Inventor: Max Hartmannsgruber, Kirchheim, Fed. Rep. of Germany

[73] Assignee: Firma Zinser Textilmaschinen GmbH, Ebersbach, Fed. Rep. of Germany

[21] Appl. No.: 195,017

[22] PCT Filed: Oct. 22, 1979

[86] PCT No.: PCT/EP79/00082

§ 371 Date: Jun. 21, 1980

§ 102(e) Date: Jan. 28, 1980

[87] PCT Pub. No.: WO80/00853

PCT Pub. Date: May 1, 1980

[30] Foreign Application Priority Data

Oct. 21, 1978 [DE] Fed. Rep. of Germany ..... 2845933

[51] Int. Cl.[3] ..... D01H 7/10; D01H 1/244

[52] U.S. Cl. ..... 57/100; 29/467; 57/1 R; 57/129

[58] Field of Search ..... 57/129–135, 57/100, 1 R; 29/462–469, 271

[56] References Cited

U.S. PATENT DOCUMENTS

| | | | |
|---|---|---|---|
| 1,721,280 | 7/1929 | Peineke | 57/100 |
| 1,789,676 | 1/1931 | Friederich | 57/100 |
| 2,474,210 | 6/1949 | Abbott | 57/100 |
| 2,571,267 | 10/1951 | Ljunggren | 57/100 |
| 3,095,687 | 7/1963 | Beerli | 57/129 X |
| 3,555,804 | 1/1971 | Murph | 57/1 R X |
| 3,742,268 | 6/1973 | Volkrodt | 57/100 X |

FOREIGN PATENT DOCUMENTS

| | | | |
|---|---|---|---|
| 1785232 | 7/1971 | Fed. Rep. of Germany . | |
| 1453865 | 9/1964 | France . | |
| 358378 | 4/1938 | Italy . | |
| 260396 | 11/1926 | United Kingdom | 57/100 |
| 262028 | 12/1926 | United Kingdom | 57/100 |
| 621600 | 4/1949 | United Kingdom | 57/100 |

*Primary Examiner*—John Petrakes
*Attorney, Agent, or Firm*—Edwin E. Greigg

[57] ABSTRACT

The invention relates to a spinning or twisting machine with a plurality of upright textile spindles, wherein the spindle shaft of each textile spindle is coaxially firmly attached to the rotor shaft of an electromotor and wherein the housing of the electromotor includes upper and lower bearing brackets that are disposed on a spindle rail and for the purpose of simple and precise centering of the electromotor housing these bearing brackets are radially adjustable on the spindle rail independently of one another.

7 Claims, 3 Drawing Figures

SPINNING OR TWISTING MACHINE

BACKGROUND OF THE INVENTION

The invention relates to a spinning or twisting machine in accordance with the type described in the preamble to claim 1.

Machines of this type serve to spin or twist yarns. It is known to drive each textile spindle of such a machine by means of a separate electromotor assigned to only that spindle. This kind of drive is also called "individual spindle drive". However, it is difficult to center the spindle shaft of the spindle, which is coaxial with the shaft of the rotor, and firmly connected to the rotor shaft, precisely relative to the ring which is pierced thereby and disposed on the spindle rail. This ring, which is also called a spinning or twisting ring, serves to carry a ring rotor which is revolvingly dragged on this ring by the yarn traveling toward the spindle. It is accordingly important that the spindle shaft, in all positions of the ring rail performing stroke movements during operation, should be very well centered with the ring which moves up and down along with the ring rail; otherwise, there is an increased danger of broken threads, and the wear on the rotor is increased and it can even happen that the ring rotor may strike against the yarn winding body which during the wind-up operation is located on a casing placed over the spindle shaft.

OBJECT AND SUMMARY OF THE INVENTION

It is accordingly a principal object of the invention, in a spinning or twisting machine of the type described herein, to create the opportunity to center each spindle shaft precisely, simply, quickly, and uncomplicatedly, and using gauges as needed, relative to the ring pierced thereby and located on the ring rail throughout the maximum stroke of this ring rail.

This object is attained by means of the invention disclosed herein. Because both bearing brackets of the housing of the electromotor are disposed on a spindle rail independently of one another and adjustable in position radially on all sides, the rapid and precise centering of the spindle shaft relative to the ring pierced thereby throughout the maximum stroke height of the ring rail carrying this ring can be accomplished in a structurally simple manner.

Normally, on a ring spinning or ring twisting machine, the textile spindles are disposed in two rows; that is, there is one row on each longitudinal side of the machine. It is also possible, however, that only a single row of spindles may be present. In general, it is sufficient to assign a single spindle rail to each such spindle row and only in special cases to provide a plurality of separate spindle rails. In similar fashion, the rings assigned to one spindle row, which are pierced by the spindle shaft and carry ring rotors, are efficiently disposed on a single ring rail; however, here as well, there may be a plurality of ring rails provided per spindle row.

There are ring rails on which the rings are disposed in such a manner as to be immovable radially, and there are ring rails on which the rings can be secured in a manner which is adjustable in position to a limited extent radially on all sides. It is always desirable that the longitudinal axes of the rings of one ring rail should lie in a single common plane and should be at uniform distances from one another; that is, there should be an exact distribution of spindles. As a result of the invention, it is possible both to center the spindle shafts quickly and precisely with respect to these rings when the particular row of rings has rings disposed in exact distribution, and thus to perform an exact distribution of spindles as well; it is also possible, first, to dispose the bearing brackets of the electromotors of one textile spindle row in such a manner that the longitudinal axes of the bearings for the rotor shafts contained therein will lie in a single plane and will be at uniform distances from one another, and only thereafter to center the rings on the ring rail and the other bearing brackets.

The rotor shaft of electromotor of the textile spindles can be integral with the spindle shaft or with a central lengthwise spur of the spindle shaft; alternatively, the spindle shaft and/or a central lengthwise spur of the spindle shaft may be embodied as a separate part and firmly connected to the rotor shaft of the rotor of the electromotor.

The phrase "radial adjustability of position on all sides of the particular bearing bracket of the electromotor of the spindle" is understood to mean that the bearing bracket can be radially adjusted relative to the rotary axis of the textile spindle in all directions.

In general, the opportunity for radial position adjustment of the individual bearing bracket needs to be only relatively limited; for instance, at least in many cases, a radial position adjustability of from two to eight millimeters are generally sufficient; in some cases it may be somewhat less or somewhat more, depending upon manufacturing tolerances.

In many cases, it is sufficient for both bearing brackets, or one of the two bearing brackets, to be immovably securable on the spindle rail. For instance, the particular bearing bracket or an annular disc secured thereon can have threaded bores into which threaded shafts of securing screws can be inserted which pass through holes in the spindle rail with a substantial amount of lateral play; these securing screws then hold the bearing bracket on the spindle rail immovably in the position initially set, and the heads of these screws are supported on the spindle rail via supporting discs.

However, because as a result of radial position adjustment of at least one of the bearing brackets, the rotary axis of the textile spindle must be permitted to pivot to a limited extent transverse to its longitudinal direction, it is necessary to provide that this pivotal movement is possible. To this end, it is sufficient for one of the two bearing brackets to be connected with the spindle rail via at least one elastic member which in yielding fashion permits such pivotal movements; this may be, for instance, an elastomeric ring, a disc spring, a screw spring, or the like. If the other bearing bracket as well is to be immovably connected to the spindle rail, it can be provided, for instance, to connect it to the spindle rail via a ball joint whose motion can be arrested; for instance, a pan can be secured in a radially adjustable manner on the spindle rail which has a bearing surface embodied as an arc portion of a circle and coaxial with the rotary axis of the textile spindle. A complementary bearing surface of the bearing bracket then is in contact with this bearing surface coaxial with the rotary axis of the textile spindle, and the ball joint can be arrested in motion, for instance, by bracing the pan with the bearing bracket; that is, the two bearing surfaces can no longer slide on one another.

In general, however, it is particularly advantageous for both bearing brackets to be connected to the spindle rail via at least one elastic member per bearing bracket. This produces particularly simple embodiments in terms of structure and has the advantage among other as well, that these elastic members permit gyroscopic movements of the rotary part of the spindle, comprising the spindle shaft and the rotor of the electromotor; in a known manner, this serves the purpose of automatic compensation for imbalances which are caused by the yarn winding body which is disposed on a casing placed on the rotating spindle shaft and engaged in winding up the yarn.

The electromotor may be of any arbitrary suitable design, for instance, an asynchronous motor with a short-circuit rotor or a self-starting synchronous motor, for instance, a shaded-pole motor. The rotor of the electromotor can preferably be supported by means of slide bearings in both bearing brackets and by means of a pivot bearing located in the lower bearing bracket.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
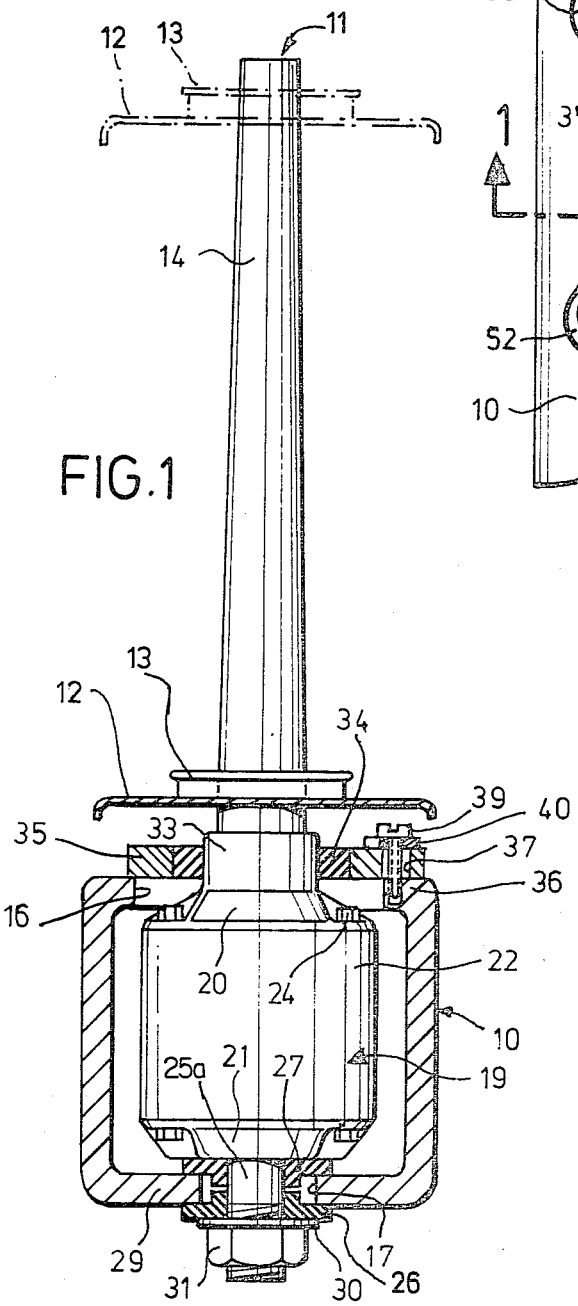
FIG. 1 is a side view of a textile spindle disposed on a spindle rail, which is shown in a sectional view taken along lines 1—1 of FIG. 2; the ring rail is also shown in section, but the textile spindle is shown in an elevational view.

In FIG. 1, a spindle rail 10, a textile spindle 11 and a ring rail 12 of a spinning or twisting machine, not shown in further detail, can be seen. The spindle rail 10 and the ring rail 12 extend substantially over the length of the particular machine. The spindle rail 10 can be fixedly disposed on a machine frame, and the ring rail 12 is guided in a straight line vertically and can be driven to perform constant stroke movements by a stroke mechanism, not shown. The lowest possible position of the ring rail 12 is shown in solid lines, and the highest possible position of the ring rail 12 is indicated by dot-dash lines. A number of rings 13, also known as spinning or twisting rings, are disposed in one row on the ring rail 12. A ring rotor, not shown, can be placed on the ring 13. The yarn, which is traveling toward the textile spindle 11 and is to be wound up on the casing, not shown, which is to be placed on the spindle shaft 14, passes through this ring rotor and accordingly drags this ring rotor on the ring 13 along with it.

The spindle rail 10 comprises a fixed tube of square cross section.

This spindle rail 10 has circular holes 16, 17 for each textile spindle 11 disposed thereon, the holes 16, 17 being disposed at the top and at the bottom of the spindle rail 10, respectively. The diameter of the upper hole 16 is slightly larger than the outer diameter of the electromotor 19 of the textile spindle 11, which is to be inserted therethrough toward the bottom into the interior of the spindle rail 10. This electromotor 19 has a housing, comprising an upper bearing bracket 20, a lower bearing bracket 21 and a cylindrical central portion 22, on the two end faces of which these bearing brackets 20, 21 are secured by means of screws, such as 24. The central portion 22 of the housing can be a casing, including the stator of this electromotor 19 in a known fashion, or it may also be embodied by the sheet-metal packet of the stator of this electromotor 19, as is also known.

Figure 2:
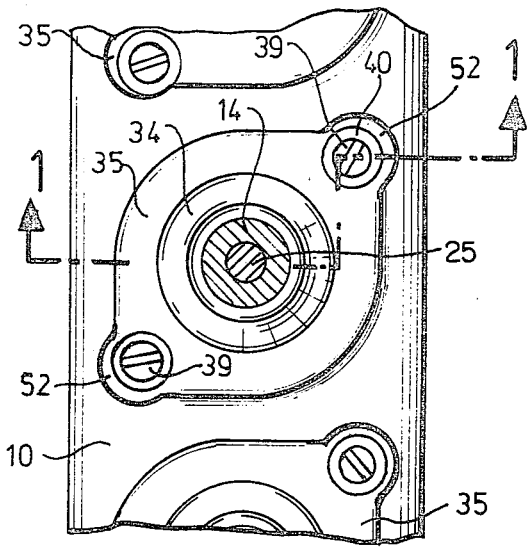
FIG. 2 is a top plan view on a portion of the spindle rail of FIG. 1, wherein the ring rail has been omitted and the spindle shaft of the spindle is cross hatched.

The bearing brackets 20, 21 contain slide bearings or roller bearings for supporting the rotor shaft 25, which can be seen only in FIG. 2. Preferably, the lower bearing bracket 21 can have a pivot bearing for supporting the lower end face of the rotor shaft 25.

The vertical spindle shaft 14 of this textile spindle 10 is firmly disposed on the vertically directed rotor shaft 25, and coaxially therewith. This spindle shaft 14 may be of aluminum, for instance, and may be pressed onto the rotor shaft 25. In this exemplary embodiment, the rotor shaft 25 thus simultaneously represents a spur protruding into the spindle shaft.

The lower bearing bracket 21 has a cylindrical threaded tang **25*a* disposed fixedly thereon and protruding downward, whose longitudinal axis is in alignment with the rotary axis of the electromotor 19 and thus with the rotary axis of the textile spindle 11. Two holder rings 26, 27 embodied as flange rings, and made or reinforced or unreinforced elastomeric material such as rubber or elastic plastic, are disposed one above the other on this threaded tang 25*a*. These two holder rings 26, 27 are embodied identically and disposed in mirror-symmetrical fashion relative to one another, and are also rotationally symmetrical and disposed coaxially with the longitudinal axis of the threaded tang 25*a* in a form-locking manner thereon. The upper holder ring 27 rests with its outer flange on the upper side of the horizontal, flat base portion 29 of the spindle rail 10, and the lower holder ring 26 abuts against the flat underside of this base portion 29 of the spindle rail 10. Furthermore, the upper holder ring 27 rests on a flat end face of the lower bearing bracket 21, and the lower holder ring 26 rests on a supporting disc or washer 30, which is placed on a tightening nut 31 threaded onto the threading of the threaded tang 25*a*, so that by rotating the tightening nut 31, the two holder rings 26, 27 between the bearing bracket 21 or the supporting disc 30 and the base portion 29 of the spindle rail 10 are given an initial stress, as shown, which can be adjusted by means of rotating the tightening nut 31. Accordingly, two holder rings 26, 27 hold this threaded tang 25*a* and thus the electromotor 19** in an elastic fashion.

The tightening nut 31 can be loosened to such an extent that the threaded tang **25*a* together with the holder rings 26, 27 can be displaced radially on all sides relative to the spindle rail 10 within the limits determined by the hole 17. To this end the means defining the opening 17 has a diameter which is substantially larger, for instance, from 2 to 8 mm larger, than the short, cylindrical portions of the holder rings 26, 27** located therein.

The upper bearing bracket 20 has a protrusion 33 in the form of a cylindrical, casing-like collar extension, which is an integral component of the bearing bracket 20 and is disposed coaxially with the rotary axis of the textile spindle 11. A cylindrical, rotationally symmetrical holder ring 34 of square cross section and made of elastomeric material, such as reinforced or unreinforced rubber or plastic, is disposed in a form-locking fashion on this collar or protrusion 33 and may, as needed, be glued thereto. In a simplified form, this holder ring 34 is secured by means of gluing or in some other manner in an outer ring 35, which has the form visible in plan view in FIG. 2 which is circular-cylindrical and encloses this holder ring 34 completely in a form-locking manner. This outer ring 35 is placed upon the flat, horizontal top 36 of the spindle rail 10. At each of the ends 52 most remote from one another, there is a circular hole, such as 37. This means defining the opening has a diameter which is much larger, for instance 2 to 8 mm larger, than the outer diameter of the securing screw 39 which passes through this opening 37 and inserted into a threaded bore of the top 36 of the spindle rail 10, the head of this screw 39 being arranged to rest on a supporting disc 40, so that when the two securing screws 39 of this outer ring 35 are loosened the outer ring 35 and thus the upper bearing bracket 20 connected therewith via the elastomeric holder ring 34 can be radially displaced on all sides to the extent determined by the oversize of the holes 37 relative to the diameter of the threaded shafts of the securing screws 39. By means of tightening these two securing screws 39, the outer ring 35 can then be immovably connected to the spindle rail 10 in the initially set position once again.

Various procedures can be followed in order to center all the textile spindles 11 disposed on this straight, horizontal spindle rail 10 in the rings disposed on the ring rail 12. Two particularly advantageous possibilities are the following:

If the rings 13 on the ring rail 12 are radially adjustable in position, they can at first be left in any arbitrary radial position and then, only after loosening the securing screws 39 and the tightening screws 31, all the spindle shafts 14 can be oriented such that their longitudinal axes are located in a single common, vertical plane and are at constant distances from one another. Then the securing screws 39 are tightened in order to secure the outer rings 35 on the spindle rail 10 in an immovable manner, and then the rings 13 are centered with respect to the spindle shafts 14 and the ring rail 12 is moved into its uppermost position, indicated by dot-dash lines; next, the lower bearing brackets 21 of these textile spindles 12 are adjusted in radial position one at a time, in sequence, such that the spindle shaft 14 in the ring 13 is also precisely centered in the new, higher position of the ring; finally, the tightening nuts 31 of the textile spindles which have now been centered are tightened, so that this centered position of the spindle shaft 14 is not adjusted again.

Alternatively, one can proceed in such a manner that first the rings 13 are disposed on the ring rail 12 in such a manner that their longitudinal axes are at constant distances from one another and are located in one common, vertical plane, to the extent that the rings 13 are radially adjustable in position. Should this latter not be the case, the rings 13 naturally do not need to be adjusted, because in that case they are already oriented relative to one another as has been described before. The securing screws 39 and tightening nuts 31 are loosened so that the spindle shaft 14 may be centered by means of a radial adjustment of position of the upper bearing bracket 20 and a corresponding displacement therewith of the outer ring 35. When this has taken place for all the textile spindles of this row of spindles, the ring rail 12 is then moved upward to such an extent that all the securing screws 39 can be tightened to provide immovable securing of the positions of the outer rings 35 which have thus been set. After tightening of the screws 39, the ring rail 12 is moved into the highest position and now, as has been described above, the spindle shafts 14 are centered one after another relative to the rings 13 now located in this new, highest position, by means of the radial adjustment of position of the bearing brackets 21. This centered position is then fixed by tightening each of the particular tightening nuts 31.

In the case of both methods described, each spindle shaft 14 is centered relative to the ring which it pierces in such a manner that the centering is very precise over the entire maximum stroke height of the ring 13, because the centering of the spindle shaft 14 in the lowermost position of the ring 13 can change not at all, or only insignificantly, in centering the spindle shaft 14 in the uppermost position of the ring 13, because of the short distance between the lowermost position of the ring 13 and the upper bearing bracket 20. However, should the centering at the one or another textile spindle in the lowermost position of the spindle rail no longer be sufficiently precise after the centering in the uppermost position of the spindle rail, then the centering of the spindle shaft 14 can be performed once again, which is then even more precise because of the more precise outset position.

The centering of the spindle shaft 14 in the ring 13 may be done, or made easier, by means of gauges known per se or also during optical dimensioning, or in some other suitable manner.

Figure 3:
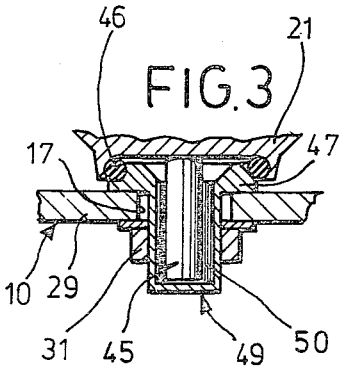
FIG. 3 is a lengthwise section taken through a variant, shown in detail, of the textile spindle of FIG. 1, which shows a different bearing for the lower bearing bracket of the electromotor of this textile spindle.

Because in a known fashion the rotating portion of the textile spindle 10 is intended efficiently to be able to behave like a gyroscope during operation, which is already possible in this case because of the elastic holder rings 26, 27 and 34, it can frequently be efficient to damp the gyroscopic movements of this rotatable spindle element, comprising the spindle shaft 14 and the rotor of the electromotor 19, to a greater extent. One advantageous damping possibility is illustrated in an exemplary embodiment in FIG. 3, which shows only a small portion, in section, of the lower bearing bracket 21 of the electromotor of the textile spindle. This electromotor, like the holder means of its upper bearing bracket as well, and the spindle shaft may be embodied as in FIGS. 1 and 2. The sole difference from the exemplary embodiment of FIGS. 1 and 2 may thus be in the different holding means of the lower bearing bracket 21 as shown here. On the bottom of this lower bearing bracket 21, there is an indentation with an undercut portion on the circumference, which is disposed coaxially with a cylindrical tang 45 firmly attached to the bearing bracket 21, which protrudes downward and is coaxial with the rotary axis of the textile spindle. In this circumferential undercut portion, a holder ring 46 of circular cross section and made of elastomeric material such as rubber or plastic is held, being seated in an annular groove of the upper outer flange 47 of a cup 49, the annular groove being coaxial with the longitudinal axis of the tang 45. This cup 49 is open only on the upper side, and the tang 45 protrudes into it up to the vicinity of its flat bottom, with a considerable amount of lateral play. This tang 45 is surrounded loosely in the region of the circular-cylindrical interior of the cup 49 by a spiral spring 50, whose windings are a short distance from one another, and damping oil has been poured into this cup 49 up to the top of the spiral spring 50. As a result, when the bearing bracket 21, as the spindle shaft 14 rotates, oscillates as a result of the elastic holder ring 46 relative to the cup 49 which is held immovably on the base portion 29 of the spindle rail 10, these oscillations, which correspond or can correspond to gyroscopic movements, are particularly well damped, because the oil located between the windings of the spiral spring 50 is moved to and fro and thus has a high flow resistance.

The cup 49, with its lower cylindrical portion, passes through a cylindrical hole 17 in the base portion 29 of the spindle rail 10 with substantial radial play of 2 to 8 mm, for instance. This cylindrical cup portion has an outer thread, onto which a nut 31 is threaded, by means of which the cup 49, seated with its outer flange 47 at the top of the base portion 29 of the spindle rail 10, can be securely fastened to the spindle rail 10 in any radially adjustable position.

If it is desired to adjust the lower bearing bracket 21 radially, the nut 31 is loosened and the cup 49 and thus the lower bearing bracket 21 can then be radially adjusted on all sides to the extent that the lateral play of the cup 49 in the opening 17 of the base portion 29 permits this movement.

In place of the damping spiral screw 50, other damping devices which cooperate with a damping oil can also be disposed in the cup 49 as needed, such as elastic foam having open pores, a tube-like casing or a plurality of tube-like casings or bowls or the like placed one inside the other with a small amount of play between them.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A spinning or twisting machine comprising:

a spindle rail having a linear axis, said spindle rail including an upper opening and a lower opening coaxial with the linear axis, a textile spindle disposed in an upright position on said spindle rail, a rotatable shaft cooperating with the textile spindle, an electromotor disposed within said spindle rail and having a rotor shaft driven by the electromotor, said rotor shaft being connected with said rotatable shaft to drive said textile spindle, an upper bearing bracket and a lower bearing bracket of the electromotor disposed on said spindle rail, said upper bracket being connected to said spindle rail by at least one elastic member, said lower bearing bracket including a dependent rigid tang, said rigid tang extending into a cup that protrudes through said lower opening in said spindle rail and is radially adjustable relative to said lower opening, an elastomeric holder ring interposed between said lower bearing bracket and said cup, a damping means including oil as a damping medium disposed in said cup for reducing oscillations of said electromotor and said spindle shaft, a ring disposed on a ring rail with the spindle passing coaxially through the ring, said upper and lower bearing brackets are disposed on the spindle rail and are adjustable in position radially on all sides independently of one another relative to said spindle rail.

2. A machine in accordance with claim 1, characterized in that said at least one elastic member is a rotationally symmetrical, preferably elastomeric holder ring that is disposed coaxially relative to the rotary axis of the textile spindle.

3. A machine in accordance with claim 2, characterized in that said holder ring encloses in a form-locking manner, a tang-like protrusion of the particular bearing bracket which is coaxial with the rotary axis of the textile spindle.

4. A machine in accordance with claim 3, characterized in that said protrusion of said bearing bracket carries two elastomeric holder rings disposed one above another thereon in a form-locking manner and further that said protrusion passes through a means defining an opening in said spindle rail with substantial lateral play, and further that said elastomeric holder rings are tightened to said spindle rail by means of a tightening nut.

5. A machine in accordance with claim 2, characterized in that said holder ring is secured on a rigid outer ring which is radially adjustable relative to said spindle rail.

6. A machine in accordance with claim 1, characterized in that said holder ring seals the confronting surfaces of said holder ring and cup.

7. A method for adjusting the textile spindles of a ring spinning or twisting machine comprising the steps of:

(a) positioning a spindle rail adjacent to a textile machine, said spindle rail having upper and lower means defining openings therein, (b) assembling upper and lower bracket members on the opposite end walls of an electromotor supportive of a spindle shaft, (c) attaching an upper holder ring to said upper bracket member, said holder ring having an extent sufficient to cover the upper opening in said spindle rail, (d) inserting said electromotor and its attached brackets and holder ring into said upper opening in said spindle rail, (e) assembling lower holder rings carried by said electromotor to the lower opening in said spindle rail, (f) fastening in proper vertical orientation said spindle shaft by means of said upper holder ring to said spindle rail, and (g) adjusting the spindle shaft by securing the lower holder rings to said lower spindle rail.

* * * * *